US007171776B2

(12) United States Patent
Staley, III

(10) Patent No.: US 7,171,776 B2
(45) Date of Patent: Feb. 6, 2007

(54) WEAPON SIGHT HAVING ANALOG ON-TARGET INDICATORS

(75) Inventor: John R. Staley, III, Dallas, TX (US)

(73) Assignee: Raytheon Company, Waltham, MA (US)

( * ) Notice: Subject to any disclaimer, the term of this patent is extended or adjusted under 35 U.S.C. 154(b) by 205 days.

(21) Appl. No.: 11/022,242

(22) Filed: Dec. 23, 2004

(65) Prior Publication Data

US 2006/0010761 A1 Jan. 19, 2006

Related U.S. Application Data

(60) Provisional application No. 60/552,262, filed on Mar. 10, 2004.

(51) Int. Cl.
*F41G 1/48* (2006.01)

(52) U.S. Cl. ..... 42/142; 42/111

(58) Field of Classification Search ..... 42/111, 42/130, 131, 132, 140, 142
See application file for complete search history.

(56) References Cited

U.S. PATENT DOCUMENTS 3,824,699 A * 7/1974 Lenz et al. ..... 33/334
4,384,198 A 5/1983 Williamson
4,494,198 A 1/1985 Smith et al.
4,524,675 A * 6/1985 Durenec et al. ..... 89/41.06
4,695,161 A * 9/1987 Reed ..... 356/254
4,777,352 A 10/1988 Moore
4,787,291 A 11/1988 Frohock
4,841,659 A 6/1989 Williams
5,026,158 A 6/1991 Golubic
5,375,072 A 12/1994 Cohen
5,406,733 A * 4/1995 Tarlton et al. ..... 42/119
5,555,662 A 9/1996 Teetzel
5,669,174 A 9/1997 Teetzel
5,694,202 A 12/1997 Mladjan et al.
5,711,104 A * 1/1998 Schmitz ..... 42/111

(Continued)

FOREIGN PATENT DOCUMENTS

DE 39 33 042 A1 6/1990

(Continued)

OTHER PUBLICATIONS

U.S. Appl. No. 60/552,262, filed Mar. 10, 2004 by inventor John R. Staley III for "Field Programmable Multiple Role, Dual Sight Fire Control System".

(Continued)

*Primary Examiner*—Michael J. Carone
*Assistant Examiner*—Bret Hayes
(74) *Attorney, Agent, or Firm*—Haynes and Boone, LLP

(57) ABSTRACT

A device has structure that can support the device on a weapon, and a range portion that specifies a range to a target. A sensor portion provides sensor information representing an orientation of the device, and an electronic control portion is responsive to sensor information from the sensor portion and a range from the range portion for calculating how to hit the target with a munition. The device includes a sight that facilitates weapon orientation in preparation to fire the munition, the sight having an analog indicator that is disposed within its field of view and that is responsive to the electronic control portion for indicating how to orient the weapon so that the munition will hit the target.

18 Claims, 8 Drawing Sheets

U.S. PATENT DOCUMENTS

| | | | | |
|---|---|---|---|---|
| 5,726,747 | A * | 3/1998 | Houlberg et al. | 356/139.04 |
| 5,737,068 | A | 4/1998 | Kaneko et al. | |
| 5,740,037 | A | 4/1998 | McCann et al. | |
| 5,824,942 | A | 10/1998 | Mladjan et al. | |
| 5,831,198 | A | 11/1998 | Turley et al. | |
| 5,834,676 | A | 11/1998 | Elliott | |
| 5,864,481 | A | 1/1999 | Gross et al. | |
| 5,960,576 | A * | 10/1999 | Robinson | 42/90 |
| 5,974,940 | A | 11/1999 | Madni et al. | |
| 6,172,747 | B1 * | 1/2001 | Houlberg | 356/139.04 |
| 6,196,455 | B1 * | 3/2001 | Robinson | 235/70 A |
| 6,247,259 | B1 | 6/2001 | Tsadka et al. | |
| 6,252,706 | B1 | 6/2001 | Kaladgew | |
| 6,269,581 | B1 | 8/2001 | Groh | |
| 6,449,892 | B1 * | 9/2002 | Jenkins | 42/1.01 |
| 6,473,980 | B2 * | 11/2002 | Ripingill et al. | 33/506 |
| 6,487,809 | B1 | 12/2002 | Gaber | |
| 6,499,382 | B1 | 12/2002 | Lougheed et al. | |
| 6,873,406 | B1 * | 3/2005 | Hines et al. | 356/141.1 |
| 6,886,287 | B1 | 5/2005 | Bell et al. | |
| 2002/0092224 | A1 | 7/2002 | Weichert et al. | |
| 2004/0004707 | A1 | 1/2004 | DeFlumere | |
| 2004/0125357 | A1 | 7/2004 | Ohtomo et al. | |
| 2005/0018041 | A1 | 1/2005 | Towery et al. | |

FOREIGN PATENT DOCUMENTS

| | | | |
|---|---|---|---|
| DE | 197 19 977 | C1 | 10/1998 |
| DE | 198 000 925 | A1 | 7/1999 |
| DE | 199 49 800 | A1 | 4/2001 |
| DE | 19949800 | A1 * | 4/2001 |
| EP | 0 785 406 | A2 | 7/1997 |
| EP | 1 046 877 | A1 | 10/2000 |
| EP | 1 219 973 | A2 | 7/2002 |
| FR | 2 696 838 | | 4/1994 |
| GB | 2225844 | | 6/1990 |
| GB | 2252398 | | 8/1992 |
| WO | WO 9320399 | A1 * | 10/1993 |
| WO | WO 01/40849 | A2 | 6/2001 |

OTHER PUBLICATIONS

U.S. Appl. No. 11/021,847, filed Dec. 23, 2004 by inventor John R. Staley III for "Device With Multiple Sights For Respective Different Munitions".

U.S. Appl. No. 11/021,822, filed Dec. 23, 2004 by inventor John R. Staley III for "Weapon Sight Having Multi-Munitions Ballistics Computer".

U.S. Appl. No. 11/021,966, filed Dec. 23, 2004 by inventor John R. Staley III for "Common Aperture Time-Division-Multiplexed Laser Rangefinder".

U.S. Appl. No. 11/021,969, filed Dec. 23, 2004 by inventor John R. Staley III for "Weapon Sight With Ballistics Information Persistence".

"Land Warrior", FAS Military Analysis Network, printed from www.fas.org/man/dod-101/land/land-warrior.htm on Feb. 14, 2006, pp. 1-5, date unknown.

PCT Search Report (PCT/ISA/220 and 210) and Written Opinion (PCT/ISA/237) dated May 17, 2006 for PCT Application No. PCT/US2005/031384, 10 pages.

* cited by examiner 114
66
10
68

91
118
BEAM SPLITTER
171
RETICLE
186
INTERFACE
181
116
36
62
118
156
178
183
DETECTOR
SWITCH
INTERNAL DISPLAY
176
177
LASER DIODE
157
TARGET
56
IR ILLUMINATOR
PROCESSOR
MEMORY
221
EXTERNAL DISPLAY
118
58
217
38
IR POINTER
PROGRAM
USER CONTROLS
166
ELECTRONIC CONTROL CIRCUIT
216
223
222
59
DATA
VISIBLE POINTER
POWER
BATTERY
231
203
206
208
LIGHT SENSOR
ORIENTATION SENSORS
ACCELERATION SENSOR
201
SENSOR SECTION

WEAPON SIGHT HAVING ANALOG ON-TARGET INDICATORS

This application claims the priority under 35 U.S.C. §119 of provisional application No. 60/552,262 filed Mar. 10, 2004.

TECHNICAL FIELD OF THE INVENTION

This invention relates in general to techniques for aiming weapons and, more particularly, to a weapon sight that can be mounted on a weapon in order to assist with accurate aiming of the weapon.

BACKGROUND OF THE INVENTION

Over the years, various techniques and devices have been developed to help a person accurately aim a weapon such as a rifle. One common approach is to mount a sight or scope on the weapon. A person then uses the sight or scope to view an intended target in association with a reticle, often with a degree of magnification. Although existing weapon sights have been generally adequate for their intended purposes, they have not been satisfactory in all respects.

For example, it is very common for a solder to carry both a rifle and a grenade launcher. The grenade launcher is detachably coupled to the rifle, thereby effectively giving the soldier an integrated weapon that can selectively deliver either of two different types of munition. Typically, however, one sight is provided for the rifle, and a physically separate sight is provided for the grenade launcher. Further, these sights are configured so that, at any given point in time, each sight can be used with only a single type of munition. Moreover, the sight for the grenade launcher is often mounted near the outer end of the rifle barrel, thereby adding weight at a location spaced from the center-of-mass of the overall weapon, and thus necessitating greater effort by a soldier to swing the weapon to bear and then hold it on a target.

A further consideration is that, where a soldier has a grenade launcher mounted on a rifle, the soldier may be able to selectively use different bullets of the proper caliber in the rifle, or selectively use different types of grenades with the grenade launcher. Moreover, it may be a simple matter for the soldier to detach one type of grenade launcher from the rifle and quickly attach a different type of grenade launcher. Existing weapon sights provide little or no capability for quick and accurate adjustment in the field to accommodate changes in munition type and/or weapon type.

To the extent some existing weapon sights include electronic circuitry that can provide a user with electronically calculated information to assist in aiming the weapon, this information is often not visible within the same field of view in which the target is visible, and is often presented digitally in the form of alphanumeric characters that are sometimes difficult to understand and use. A further consideration relates to the extent to which calculations based on a particular target ranging event remains available for use by a user.

Still another consideration is that some weapon sights include a laser rangefinder. However, in order to achieve a high transmission efficiency for both the outgoing pulse and the reflected energy, these laser rangefinders typically have a first aperture for the outgoing pulse, and a separate second aperture for the reflected energy. Other existing laser rangefinders use a single aperture, but in association with a beam splitter having a transmissivity of approximately 50% for the laser wavelengths involved, resulting in approximately a 50% loss for the energy of the transmitted pulse, and another 50% loss for the reflected energy. This is undesirable, because it reduces the maximum range that can be measured by the rangefinder. Moreover, this is highly inefficient, which makes it undesirable for a battery-operated weapon sight, where any waste of energy reduces the amount of time that the weapon sight can operate before the battery becomes discharged.

SUMMARY OF THE INVENTION

One form of the invention relates to a weapon-mountable device having a range portion that specifies a range to a target, a sensor portion that provides sensor information representing an orientation of the device, an electronic control portion, and a sight that facilitates weapon orientation in preparation to fire a munition, and this form of the invention involves: causing the electronic control portion to be responsive to sensor information from the sensor portion and a range from the range portion for calculating how to hit the target with a munition; and causing an analog indicator that is part of the sight and disposed within the field of view of the sight to be responsive to the electronic control portion for indicating how to orient the weapon so the munition will hit the target.

BRIEF DESCRIPTION OF THE DRAWINGS

A better understanding of the present invention will be realized form the detailed description that follows, taken in conjunction with the accompanying drawings, in which.

DETAILED DESCRIPTION

Figure 1:
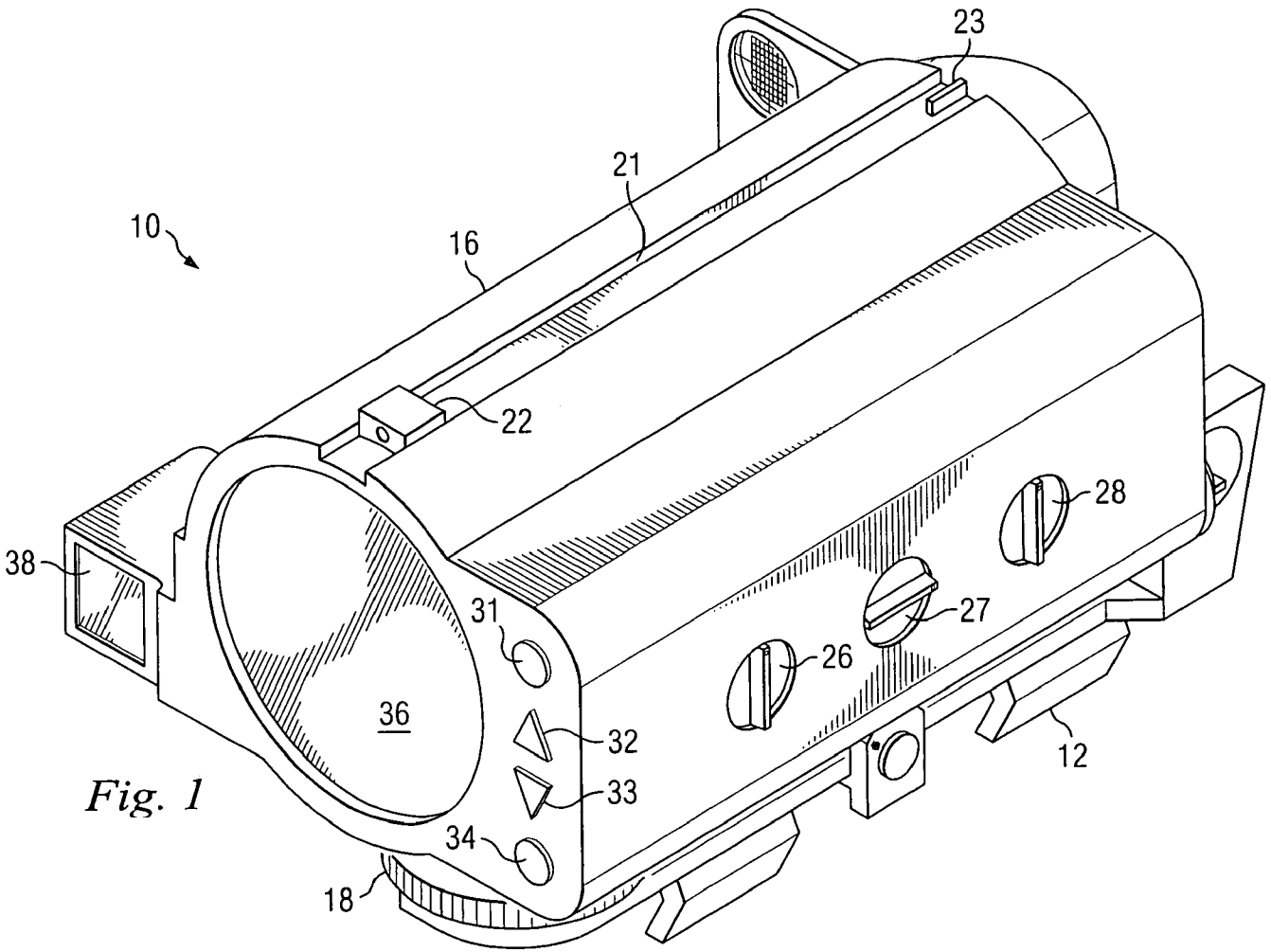
FIG. 1 is a diagrammatic perspective rear view of an apparatus in the form of a weapon sight that embodies aspects of the present invention.

FIG. 1 is a diagrammatic perspective rear view of an apparatus that is a weapon sight 10, and that embodies aspects of the present invention. Although the disclosed weapon sight 10 happens to be a rifle sight, the present invention has aspects that are not limited to rifle sights, but can be used in sights for various different types of weapons. As discussed in more detail later, the weapon sight 10 is capable of use with a rifle that can fire at least two different types of munitions. One specific example would be a military rifle having a grenade launcher removably mounted on the barrel, such that a soldier can use the rifle to fire either a munition with a low arc trajectory (such as a bullet), or a munition with a high arc trajectory (such as a grenade).

The sight 10 includes a rail mount 12 that can fixedly but removably mount the sight 10 on the receiver or mounting rail of a firearm. The sight 10 includes a housing 16. The position of the housing 16 can be adjusted relative to the rail mount 12 in a manner known in the art, in order to "zero" the sight 10 to the weapon. In the disclosed embodiment, this type of adjustment is made using thumbscrews, one of which is visible at 18.

The top of the housing 16 has a lengthwise groove 21. A backup sight has two portions 22 and 23 that are fixedly mounted in the groove 21, near opposite ends of the groove. The portion 22 is a rear sight having a cylindrical peep hole, and the portion 23 is a front sight in the form of a rounded tritium lit post.

Three manually operable rotary switches 26, 27 and 28 are provided on one side of the housing 16. Four manually operable momentary pushbutton switches 31–34 are provided on a rear surface of the housing 16. The switch 31 is a circular TOGGLE switch, the switch 32 is a triangular UP switch, the switch 33 is a triangular DOWN switch, and the switch 34 is a circular SELECT switch. The switches 26–28 and 31–34 are each configured so that they can be easily operated by someone who is wearing arctic mittens. The use of the switches 26–28 and 31–34 is discussed in more detail later.

An optical lens 36 is mounted in an opening in the rear surface of the housing 16, and is part of an eyepiece optics section of a primary optical sight that extends through the housing 16, as discussed in more detail later. Adjacent the lens 36 is a further sight in the form of a rearwardly facing external display 38. The display 38 is a known type of device, such as a liquid crystal display (LCD), and can present graphics images or video images generated by circuitry within the sight 10, in a manner discussed in more detail later.

Figure 2:
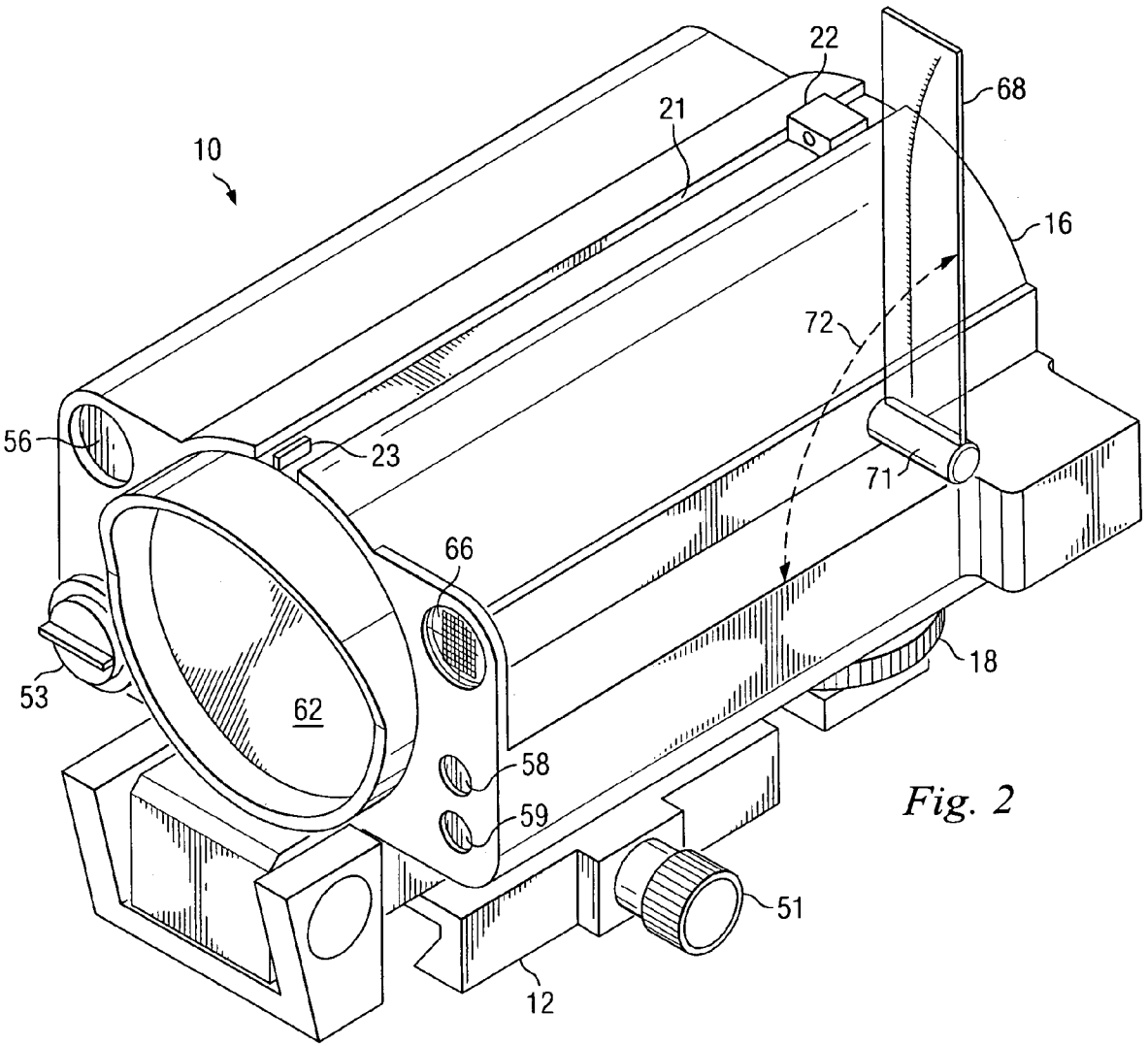
FIG. 2 is a diagrammatic perspective front view of the weapon sight of FIG. 1.

FIG. 2 is a diagrammatic perspective front view of the sight 10 of FIG. 1. A thumbscrew 51 is provided to manually tighten and loosen the rail mount 12. A removable battery compartment cover 53 provides access to batteries that power the circuitry within the sight 10.

An infrared (IR) illuminator 56 is provided in a front surface of the housing 16, and serves as a form of IR flashlight that can be used to illuminate a potential target with IR radiation. A person who is using the sight 10 and who is wearing night vision goggles will then have a better view of the potential target.

An IR pointer 58 and a visible pointer 59 are each provided in the front surface of the housing 16. The pointers 58 and 59 each produce a thin beam of radiation that can be centered on a potential target, in order to help accurately aim the weapon at the target. The beam of the visible pointer 59 can be seen with the naked eye by a person using the sight 10, but may possibly be noticed by the potential target. In contrast, the IR pointer 58 has an IR wavelength of about 950 nm. In order to see the beam of the IR pointer 58, a person using the sight 10 should be wearing night vision goggles. A potential target will not see the beam of the IR pointer, unless the target also happens to be wearing night vision goggles.

An optical lens 62 is mounted in an opening in the front surface of the housing 16, and is part of the above-mentioned optical sight that extends through the housing 16, and that will be discussed in more detail later. A sunshade 63 projects outwardly from the housing 16, above the lens 62.

A direct view grenade sight includes a front reticle 66 and a rear reticle 68. The front reticle 66 includes a circular piece of transparent material such as a hard carbon-coated polycarbonate, and is mounted in a circular opening provided through a wall of the housing 16. The front reticle 66 has thereon a reticle pattern that is discussed later. The rear reticle 68 is a rectangular piece of transparent material, such as a hard carbon-coated polycarbonate, and has thereon a reticle pattern that is discussed later. The rear reticle 68 is mounted on a cylindrical support 71, and the support 71 is pivotally supported on the housing 16. As indicated diagrammatically by a broken-line arrow 72, the rear reticle 68 can be pivoted between a vertical operational position shown in FIG. 2, and a horizontal retracted position. The rear reticle 68 is not directly visible in FIG. 1, because it is in its horizontal retracted position in FIG. 1. The front and rear reticles 66 and 68 are each backlit in a known manner, to facilitate visibility.

Figure 3:
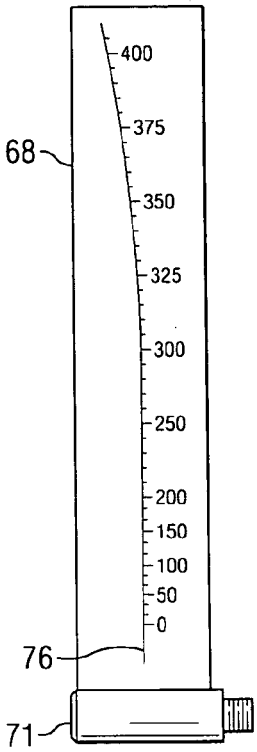
FIG. 3 is a diagrammatic rear view of a support and a rear reticle that are components of a direct view grenade sight in the weapon sight of FIG. 1.

FIG. 3 is a diagrammatic rear view of the support 71 and the rear reticle 68, with the reticle 68 in its upright operational position. FIG. 3 shows in more detail the reticle pattern 76. The reticle pattern 76 provides elevation ranging out to 400 meters, for elevations that exceed 42°. The reticle pattern 76 curves upwardly and leftwardly, in order to provide spindrift-corrected elevation ranging with better than 20 meters resolution. As is known in the art, spindrift is the tendency of a projectile to drift laterally as a result of aerodynamics that relate to the fact it is spinning as it travels through the air. Spindrift is more acute for larger projectiles such as grenades that have long flight times, as opposed to smaller projectiles with shorter flight times, such as bullets.

Figure 4:
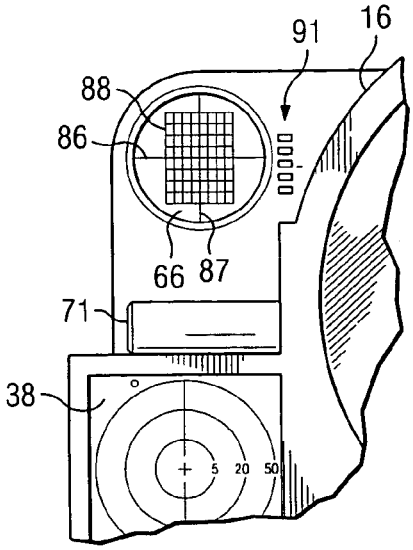
FIG. 4 is a diagrammatic fragmentary rear view, partly in section, of a portion of the weapon sight, and shows a front reticle of the direct view grenade sight.

FIG. 4 is a diagrammatic fragmentary rear view, partly in section, of a portion of the sight 10 that includes the front reticle 66 of the direct view grenade sight. In FIG. 4, the support 71 for the rear reticle 68 is in its horizontal retracted position, and is thus not visible in FIG. 4. The reticle pattern of the front reticle 66 includes perpendicular crosshairs 86 and 87, and a correction grid 88 that is centered on the crosshairs 86 and 87. A shooter can use the correction grid 88 to manually effect azimuth and/or elevational compensation for factors such as a crosswind, or a target that is at a higher or lower elevation than the shooter. To the right of the reticle 66 is an analog display 91. The display 91 is controlled by electronic circuitry that is within the housing 16, and that is explained in more detail later.

Figure 5:
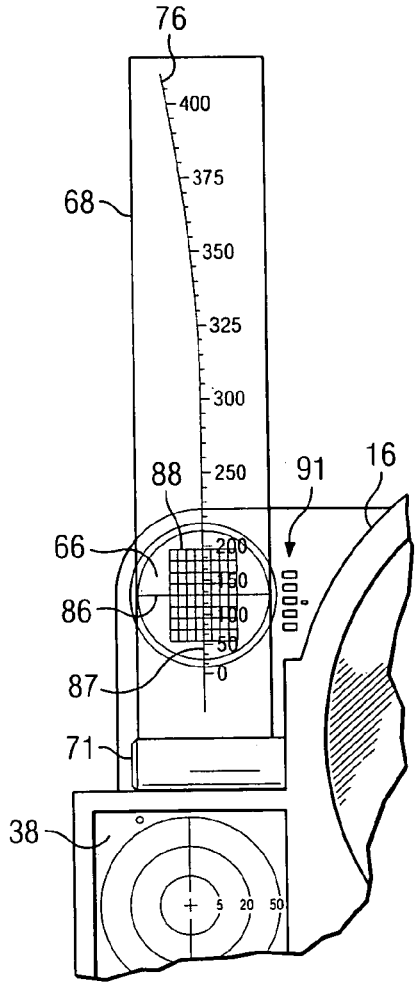
FIG. 5 is a diagrammatic fragmentary rear view similar to FIG. 4, except that the rear reticle is in an upright operational position rather than a horizontal retracted position.

FIG. 5 is a diagrammatic fragmentary rear view similar to FIG. 4, except that the rear reticle 86 is in its upright operational position, rather than its horizontal retracted position. A person using the direct view grenade sight views a potential target by looking through the rear and front reticles 68 and 66. The person centers the intersection of the crosshairs 86 and 87 on the potential target, and also aligns the intersection of these crosshairs with a point along the curve 76 that corresponds to the range to the target. If there are factors that necessitate an azimuth correction or elevation correction, the person selects a different set of crosshairs within the grid 88, and aims the weapon using the intersection of these alternative crosshairs, instead of the intersection of the main crosshairs 86 and 87.

Figure 6:
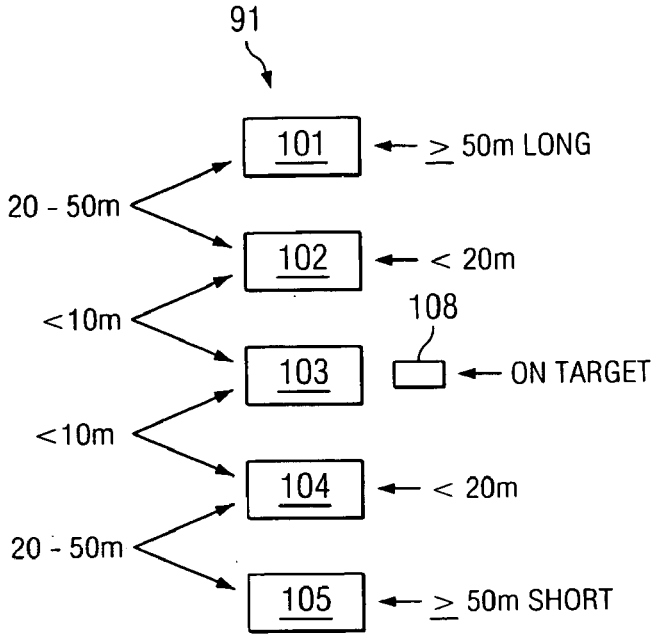
FIG. 6 is a diagrammatic view showing, in an enlarged scale, an analog display that is part of the weapon sight of FIG. 1.

When a person is looking through the aligned front and rear reticles 66 and 68, the analog display 91 is within a peripheral portion of the person's field of view. The analog display 91 provides additional information that helps in aiming the weapon. In this regard, FIG. 6 is a diagrammatic view that shows the analog display 91 in a significantly enlarged scale. The analog display 91 includes a vertical column of five light emitting diodes (LEDs) 101–105. The LEDs 101–105 are controlled by electronic circuitry within the weapon sight 10. In the disclosed embodiment, the LEDs 101–105 have different colors. In particular, the center LED 103 is green, the two outer LEDs 101 and 105 are each red, and the two remaining LEDs 102 and 104 are each yellow. Adjacent the center LED 103 is a hash mark 108, the purpose of which is to clearly designate which LED is the center LED 103.

When either of the red outer LEDs 101 or 105 is lit, it means that the weapon is currently aimed in a manner so that the elevation is long or short by an amount that will cause a grenade to miss the target by at least 50 meters. As the weapon is adjusted and the elevation approaches more closely to the target, one of the yellow LEDs 102 or 104 will also be turned on. When a red LED and the adjacent yellow LED are both on, it means that the range is between 20 to 50 meters short or long of the target. As the person continues to adjust the orientation of the weapon, the red LED will turn off, leaving only the yellow LED on. This means that the range is currently between 10 and 20 meters short or long of the target.

As manual adjustment of the weapon continues, the green center LED 103 will eventually be turned on. When the green LED 103 and one of the yellow LEDs 102 or 104 is turned on, it means that the current range is within 10 meters of the target. As adjustment continues, the yellow LED will be turned off, so that only the green center LED 103 remains on. This indicates that the current elevation is such that the range is now within 5 meters of the target.

At any point during this aiming process, if the side-to-side cant or offset of the weapon is such that the grenade would land to the left or right of the target by a distance greater than a selected threshold distance, then each LED that is lit will blink. In contrast, when there is no side-to-side cant or offset, each LED will glow continuously when it is lit. The direct view grenade sight with the reticles 66 and 68, and the analog display 91, are each used to aim the weapon with respect to the secondary munition, such as a grenade, and are not used to aim the weapon with respect to the primary munition.

Figure 7:
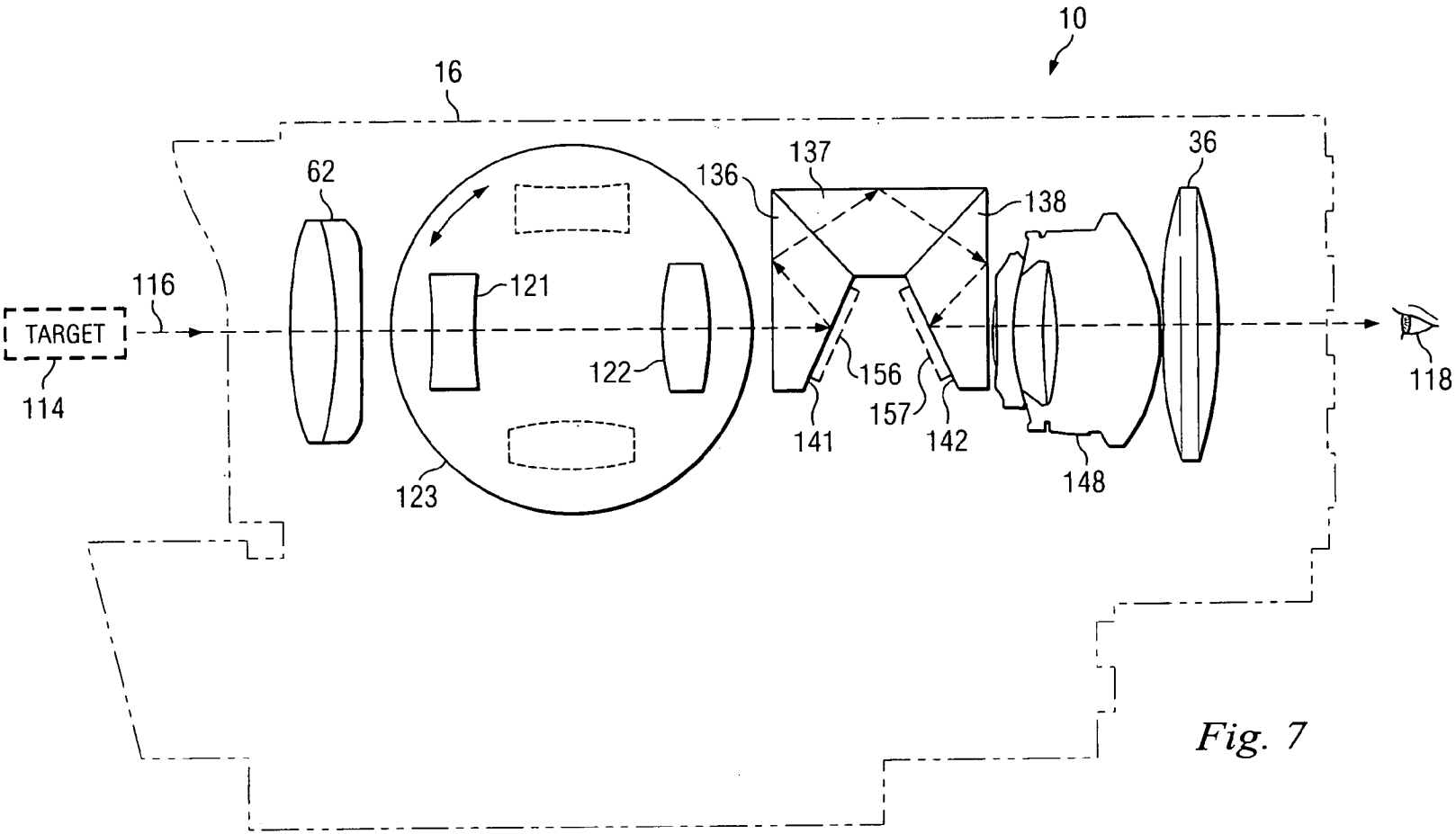
FIG. 7 is a diagrammatic view of the optics for a primary optical sight in the weapon sight of FIG. 1.

FIG. 7 is a diagrammatic view of the optics for the primary optical sight of the weapon sight 10 of FIG. 1. In this regard, FIG. 7 shows the lenses 36 and 62 that have already been mentioned above. A potential target at a remote location is shown diagrammatically at 114. A broken line 116 represents a path of travel through the sight 10 of visible radiation that embodies an optical image of the target 114. This radiation from the target 114 travels along the path 116 to an eye 118 of a user.

In more detail, after entering the sight 10, the radiation passes through the previously-mentioned lens 62. In the disclosed embodiment, the lens 62 is actually a lens doublet, and defines an optical aperture for the sight 10. After passing thorough the lens 62, radiation passes successively through two lenses 121 and 122. The lenses 121 and 122 are mounted on a support 123, and the support 123 can be reciprocally pivoted though an angle of 90°. If the support 123 is pivoted 90° counterclockwise from the position shown in FIG. 7, the lenses 121 and 122 will each move away from the path of travel 116 of the radiation, to the respective positions shown in broken lines. The pivotal position of the support 123 determines the optical magnification of the sight 10. In particular, the optical magnification is 1× when the lenses 121 and 122 are disposed in the path of travel 116, whereas the magnification is 4× when the lenses 121 and 122 are not in the path of travel 116.

The sight 10 also has a prism assembly that includes three prisms 136–138. The prisms 136–138 each have one or two surfaces that are at least partly covered by a reflective coating. For clarity, these coatings are not separately shown in FIG. 7. The coatings on the surfaces are each a type of coating that is well known in the art, but these coatings are not all identical. Except as otherwise discussed below, the coatings each reflect all of the radiation of interest that is traveling through the sight 10. After radiation has passed through the three prisms 136–138, it passes successively through a lens assembly 148 and the lens 36, and then travels to the eye 118 of the user.

Referring back to the surface 141 on the prism 136, the coating on this surface is completely reflective to visible radiation and to shorter wavelengths of IR radiation (such as a wavelength of 950 nm), but is transmissive to longer wavelengths of IR radiation (such as a wavelength of 1550 nm). This coating thus serves as a form of beam splitter. In the disclosed embodiment, this coating is a thin-film filter of a type well known in the art, and has a plurality of layers of different types of material that collectively give it the desired optical characteristic. The sight 10 has a section 156 that is shown diagrammatically in FIG. 7. The section 156 includes an infrared laser rangefinder, and is discussed in more detail later.

Turning now to the surface 142 on the prism 138, most of this surface is covered by a reflective coating, but a portion of the surface is not coated. The coated portion of the surface is completely reflective to all radiation, including both visible and infrared radiation. The sight 10 includes a section 157 that can generate visible radiation, and this visible radiation passes through the uncoated portion of the surface 142, and travels to the eye 118 of the user. The section 157 is discussed in more detail later. The primary optical sight of FIG. 7 is used to aim the weapon for purposes of rangefinding and shooting the primary munition, such as a bullet, but is not used to aim the weapon for the purpose of shooting the secondary munition.

Figure 8:
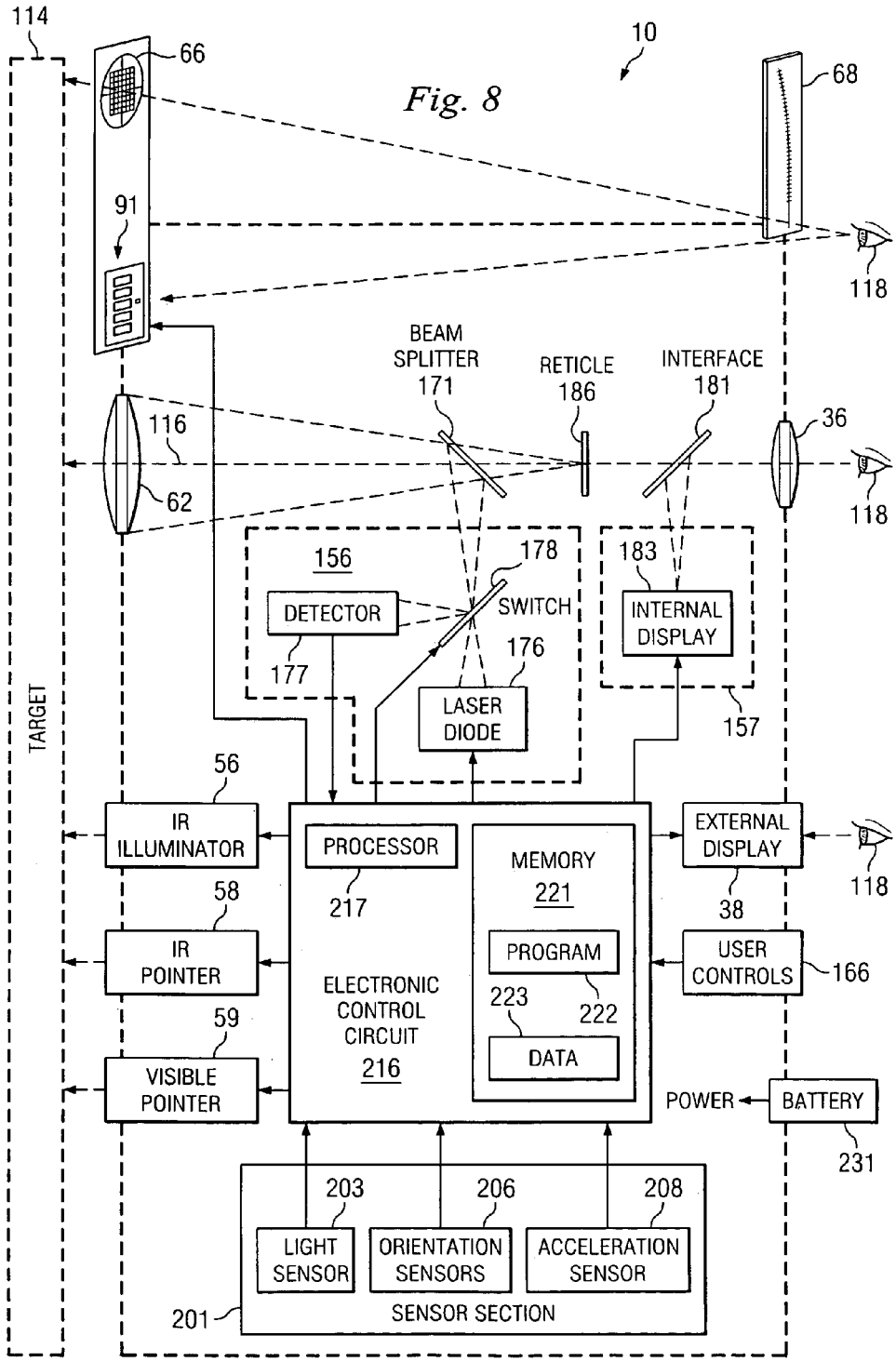
FIG. 8 is a block diagram of the weapon sight, and diagrammatically shows a number of components that are internal to the weapon sight.

FIG. 8 is a block diagram of the weapon sight 10. Some of the components shown in FIG. 8 have already been discussed above, and are therefore not discussed again in association with FIG. 8. In this regard, a block 166 in FIG. 8 collectively represents the various user controls that can be manually operated by a user, including the three rotary switches 26–28 (FIG. 1), and the three pushbutton switches 31–34 (FIG. 1). With reference to the optical arrangement shown in FIG. 7, it should be noted that, for clarity, the prisms and some of the lenses have been omitted from FIG. 8. FIG. 8 does show the eyepiece lens 36 at one end of the sight, and the objective lens 62 at the other end of the sight.

As discussed above in association with FIG. 7, the surface 141 on the prism 136 has a coating that serves as a beam splitter, and is associated with a section 156 of the sight that includes a laser rangefinder. In FIG. 8, the coating that serves as a beam splitter is shown diagrammatically at 171. As discussed above, this coating is a thin-film filter of a known type, and differentiates between two different groups of wavelengths. The wavelengths of one group include visible radiation and shorter wavelengths of IR radiation (such as a wavelength of 950 nm). The wavelengths in this group can travel along the path 116 from the target 114 to the eye 118 of the user. The wavelengths of the other group include longer wavelengths of IR radiation (such as 1550 nm). Wavelengths in this group can travel from the section 156 of the sight to the beam splitter 171 and then along the path 116 to the target 114. Similarly, these wavelengths can also travel from the target 114 along the path 116 to the beam splitter 171, and then to the section 156.

As discussed earlier, the section 156 implements an IR laser rangefinder. In more detail, the section 156 includes a laser diode 176 of a known type. The laser diode 176 can emit a short pulse of highly-focused IR radiation at a wavelength of 1550 nm. The section 156 also includes an IR detector 177 that is responsive to radiation at the wavelength of 1550 nm. The section 156 further includes a fast optical switch 178. The optical switch 178 is a device implemented with technology known in the art, such as that disclosed in PCT Publication No. WO 01/40849, published by the World Intellectual Property Organization of Geneva Switzerland on Jun. 7, 2001. The switch 178 provides a form of time division multiplexing between the laser diode 176 and the detector 177.

More specifically, when the optical switch 178 is set to a first operational mode in which it selects the laser diode 176, the laser diode 176 can emit an IR pulse that travels through the switch 176 to the beam splitter 171, and then travels along the path 116 to the target 114. After this pulse has been transmitted, the optical switch 178 is shifted to a second operational mode, in which it selects the detector 177. A portion of the energy of the transmitted IR pulse will be reflected by the target 114, and will travel back along the path 116 to the beam splitter 171, then to the switch 178, and then to the detector 177, where the pulse of reflected energy is detected. The time lapse between the emission of the IR pulse by the laser diode 176 and the detection of the reflected energy by the detector 177 is proportional to the distance traveled by the IR radiation, and is thus proportional to the distance between the sight 10 and the target 114. The use of the optical switch 178 thus achieves a laser rangefinder that uses only a single aperture, but that matches the performance of dual aperture laser rangefinders. The laser diode and the detector gain full advantage of the transmission capabilities of the common optics, without introducing power sharing losses.

As discussed above in association with FIG. 7, the surface 142 on the prism 138 is partially covered with a reflective coating, and is associated with a section 157 of the sight 10. In FIG. 8, an interface is shown diagrammatically at 181, and corresponds functionally to the coating that partially covers the surface 142. As mentioned above, the portion of the surface that is coated is completely reflective to visible radiation and IR radiation. Consequently, all visible and IR radiation that is traveling along the path 116 and that reaches the coated portion of the surface will be reflected, and will continue traveling along the path 116 to the eye 118 of a user.

As discussed earlier, the section 157 can generate a visible image. This visible image is generated using an internal display 183. The display 183 is a known type of device, such as a liquid crystal display (LCD). In the disclosed embodiment, the visible image information generated by the display 183 includes alphanumeric characters, as discussed later. This image information travels from the internal display 183 to the interface 181, and then along the path 116 to the eye 118 of a user. More specifically, and as discussed above in association with FIG. 7, this visible image information passes through the uncoated portion of the surface 142, and then travels through the lens assembly 148 and the lens 36 to the eye 118 of a user.

As shown diagrammatically at 186 in FIG. 8, a reticle is superimposed on the visible radiation that is traveling along the path 116 to the eye 118 of a user. This is one of two reticles provided by the sight 10, one of which is associated with the 1× magnification provided when the lenses 121 and 122 are disposed in the path of radiation travel 116, and the other of which is associated with the 4× magnification provided when the lenses 121 and 122 are spaced from the path of travel 116. As evident from FIG. 8, the reticle 186 used in association with 1× magnification is an aiming point in the form of a dot.

As shown diagrammatically in FIG. 8, the weapon sight 10 includes a sensor section 201 that has several sensors 203, 206 and 208. The sensor 203 is a light sensor of a known type, and can detect the degree of ambient illumination that is present externally of the weapon sight 10. The sensor 206 represents one or more sensors that can determine the orientation of the weapon sight 10, and thus the orientation of a weapon attached to the weapon sight 10. There are a variety of commercially-available electronic sensors that can detect orientation, including tilt sensors, and sensors that effectively serve as an electronic compass.

The sensor 208 is an acceleration sensor, and is capable of detecting the distinct mechanical shock that occurs when a weapon is fired. In the disclosed embodiment, the acceleration sensor 208 is implemented with a commercially-available component.

The weapon sight 10 includes an electronic control circuit 216, and the control circuit 216 includes a processor 217 of a known type. The control circuit 216 also includes a memory 221. In FIG. 8, the memory 221 is a diagrammatic representation of two or more types of memory, including read only memory (ROM), volatile random access memory (RAM), and non-volatile random access memory (such as flash RAM). The memory 221 stores a program 222 that is executed by the processor 217, and also stores data 223 that is utilized by the program 222. The control circuit 216 is responsive to the IR detector 177, the sensors 203, 206 and 208 in the sensor section 201, and the user controls 166, including the rotary switches 26–28 and the pushbutton switches 31–34 (FIG. 1). The control circuit 216 is operatively coupled to and controls the analog display 91, the internal display 183, the IR laser diode 176, the fast optical switch 178, the external display 38, the IR illuminator 56, the IR pointer 58, and the visible pointer 59. The sight 10 includes a replaceable battery 231, and this battery provides the operating power for all of the electronic components within the weapon sight 10.

Figure 9:
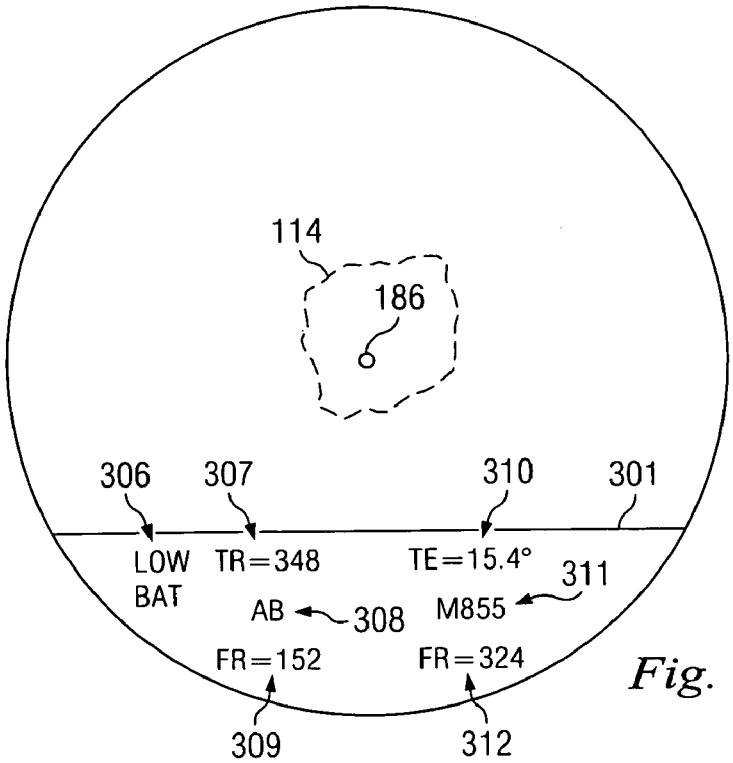
FIG. 9 is a diagrammatic view showing an example of an image that the eye of a user would see when looking through the eyepiece lens of the primary optical sight.

FIG. 9 is a diagrammatic view representing an example of the image that the eye 118 of a user would see when looking through the eyepiece lens 36 of the primary optical sight. A horizontal line 301 extends across the lower portion of this image. The portion of the image above the line 301 corresponds generally to the portion of the surface 142 (FIG. 7) that has a reflective coating, and the portion of the image below the line 301 corresponds generally to the portion of the surface 142 that is not coated. Thus, the portion of the image above the line 301 includes an image of the target 114, and includes the reticle 186. FIG. 9 assumes that the pivotal support 123 is in the position shown in FIG. 7, in which the lenses 121 and 122 are disposed in the path of radiation travel 116, and thus provide 1× magnification. As discussed above, the reticle 186 used with 1× magnification is simply a dot in the center of the overall image.

The portion of the image below the line 301 consists solely of alphanumeric information produced by the internal display 183 (FIG. 8). This alphanumeric information includes a low battery indicator LOWBAT 306, and this low battery indictor is displayed when the battery 231 (FIG. 7) is nearing a discharged state. A target range indicator 307 shows a current range to the target 114. This is normally a range that has been determined automatically using the laser rangefinder in the section 156 (FIG. 8), but can alternatively be set manually, as discussed later. The information at 308 is an indication of the current secondary munition on the weapon, such as a selected grenade type. The information at 309 is an indication of the current effective range of the secondary munition, and is dependent on factors such as the current orientation of the weapon and the sight 10. As a user changes the orientation of the weapon and the sight 10, the electronic control circuit 216 (FIG. 8) will repeatedly recalculate the effective range of the secondary munition. Thus, the information displayed at 309 will change continuously while the weapon and the sight 10 being moved.

The information at 310 is an indication of the target elevation, or in other words the angle formed with respect to a horizontal reference by a straight line extending from the sight 10 to the target 114. The information displayed at 311 is an identification of the current primary munition, such as a particular type of bullet. The information displayed at 312 is the current effective range of the primary munition. This range for the primary munition is similar to the range information displayed at 309 for the secondary munition. It is continuously updated by the control circuit 216 in response to changes in the orientation of the weapon and the sight 10.

Figure 10:
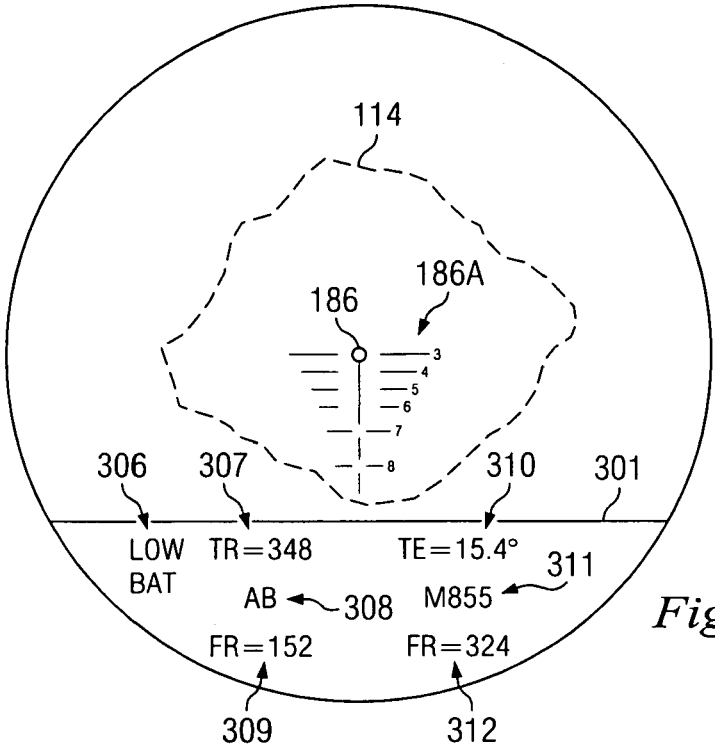
FIG. 10 is a diagrammatic view similar to FIG. 9, but showing the image that would be seen when the weapon sight is set for a higher level of magnification than shown in FIG. 9.

FIG. 10 is a diagrammatic view similar to FIG. 9, but showing the image that would be seen by an eye 118 when the sight 10 is set for a magnification of 4× rather than 1×. As discussed earlier, the magnification is changed from 1× to 4× by pivoting the support 123 90° in a counterclockwise direction from the position shown in FIG. 7. FIG. 10 is generally similar to FIG. 9, with two exceptions. First, the target 114 is significantly larger within the image, because the magnification is set at 4× rather than 1×. Second, the reticle 186 has been replaced with a different reticle 186A. The reticle 186A includes the dot or aiming point 186, and also several stadia lines of a known type that facilitate ranging.

The reticles 186 and 186A are implemented in the following manner. The reticles are each generated at the surface 142 of the prism 138, because that surface lies at the focal plane of the eyepiece lens 36 in the disclosed embodiment. In particular, the coated portion of the surface 142 has the reticle pattern 186A etched completely through the reflective coating, including the dot 186 and also the stadia lines. Under control of the control circuit 216, the internal display 183 is capable of causing just the dot 186 to be illuminated (as shown in FIG. 9), or of causing both the dot and the stadia lines to be illuminated (as shown in FIG. 10). Where only the dot 186 is being illuminated (as in FIG. 9), the stadia lines may actually be faintly visible, but they have been omitted FIG. 9 for clarity, because FIG. 9 represents a situation where the dot 186 is illuminated and the stadia lines are not. In the disclosed embodiment, the internal display 183 illuminates the dot and/or the stadia lines using a distinctive color such as red.

Instead of using the internal display 183 to illuminate the reticle, it would alternatively be possible for the sight 10 to have two light emitting diodes (LEDs) in the region of the surface 142, one of which was focused on the dot 186, and the other of which was diffused to illuminate all the stadia lines. The control circuit 216 could then selectively actuate one or both of the LEDs.

Figure 11:
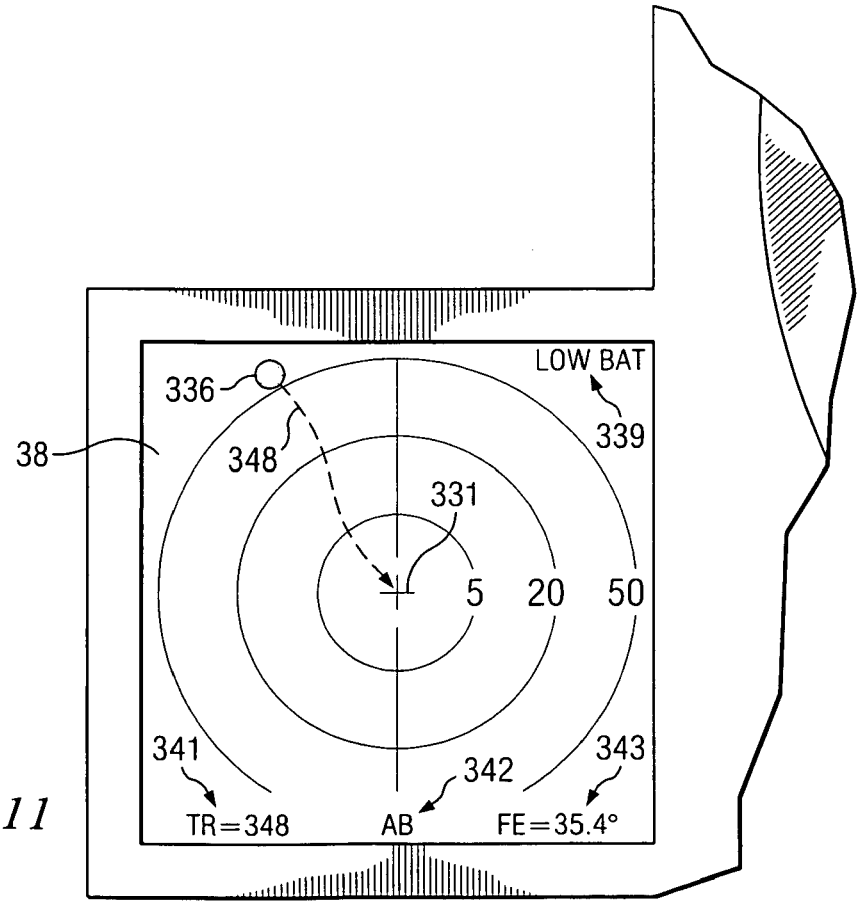
FIG. 11 is a diagrammatic view of a typical image that would be displayed by an external display of the weapon sight of FIG. 1.

FIG. 11 is a diagrammatic view of a typical image that would be displayed by the external display 38 (FIG. 1) of the sight 10. The external display 38 is used to aim the weapon for the purpose of shooting the secondary munition, such as a grenade, but is not used to aim the weapon for the purpose of shooting the primary munition. All of the information presented by the display 38 is generated electronically. This is in contrast to the images shown in FIGS. 9 and 10, where a portion of the information is an actual optical view of a remote scene, such as the target 114. In the image of FIG. 11, there is a fixed reticle that includes a center crosshair and nested concentric circles with range labels of "5", "20" and "50" meters. The target is represented by a target symbol in the form of a dot 336. In this regard, the dot 336 corresponds to the target 114 shown in prior figures, but is given a separate reference numeral in FIG. 11, because it is an electronically-generated representation of the target 114, as discussed below.

The periphery of the image in FIG. 11 includes some alphanumeric information. This alphanumeric information includes a low battery indicator 339 that is equivalent to the indicator 306 in FIG. 9, a target range indicator 341 that is equivalent to the indicator 307, and a secondary munition type indicator 342 that is equivalent to the indicator 308. In addition, the alphanumeric information at 343 indicates the angle of elevation of the weapon that is needed in order for the secondary munition to hit the target 336.

As the weapon and the attached sight 10 are moved, the electronically-generated target symbol 336 will move within the image. Thus, in order to aim the weapon, the user will manually move the weapon and the attached sight so that the target symbol 336 moves toward the crosshairs 331, as indicated diagrammatically at 348. When the target symbol 336 is aligned with the crosshairs 331, the weapon is positioned so that the grenade or other secondary munition should hit the target.

Figure 12:
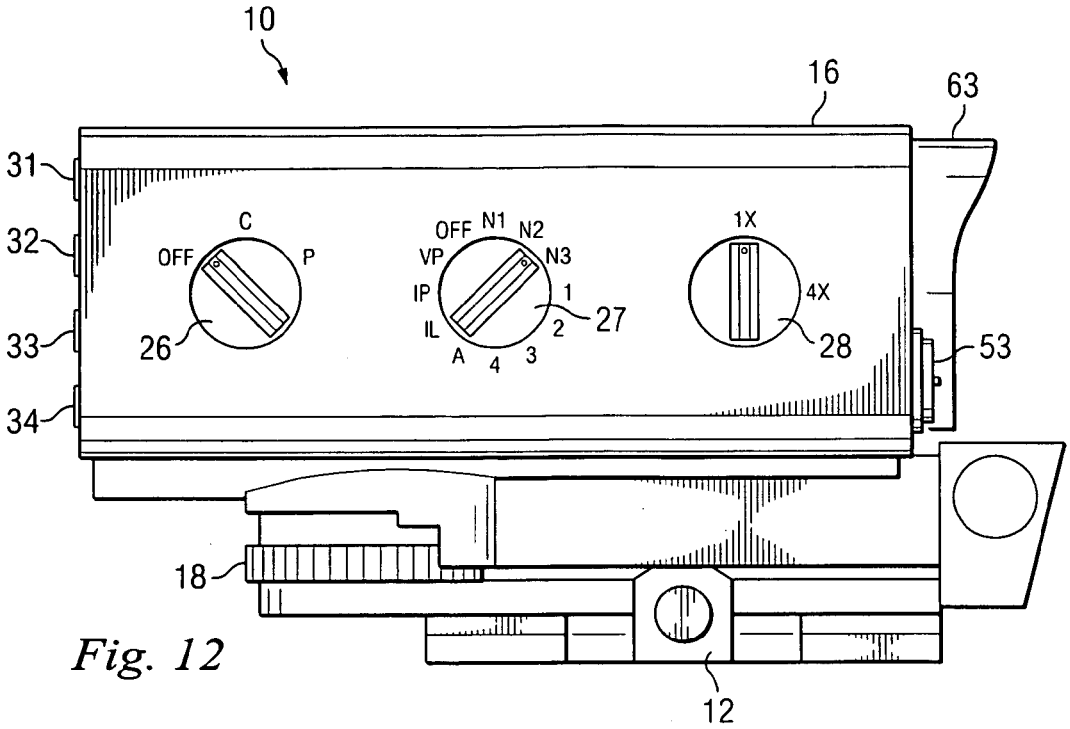
FIG. 12 is a diagrammatic side view of the weapon sight of FIG. 1.

FIG. 12 is a diagrammatic side view of the weapon sight 10. As shown in FIG. 12, the rotary switch 28 has two positions "1×" and "4×", and selects between the two levels of magnification for the main optical sight. In this regard, the switch 28 is physically coupled to the pivotal support 123 shown in FIG. 7. Manual pivoting the switch 28 through 90° between its 1× and 4× positions effects a corresponding 90° pivotal movement of the support 123, in order to move the lenses 121 and 122 into or out of the path of travel 116 and thus change the magnification. In addition, the rotary switch 28 is electrically coupled to the electronic control circuit 216 (FIG. 8), so that the control circuit 216 knows the current setting of the switch 28.

The rotary switch 27 is an illumination switch, and controls the degree of illumination of several different components of the sight 10. In particular, the illumination switch 27 controls the brightness of the external display 38, the brightness of the LEDs 101–105 of the analog display 91, the brightness of the internal display 183, and the brightness of the backlighting for the various reticles 66, 68, 186 and 186A.

In more detail, the switch 27 has three positions "N1", "N2" and "N3" that implements three different levels of brightness suitable for use by a user who is wearing night vision goggles. In a similar manner, the switch 27 includes four positions "1", "2", "3" and "4" that implement four different levels of brightness suitable for unassisted viewing, or in other words viewing by a user who is not wearing night vision goggles. The switch 27 has a further position "A", where the control circuit 201 provides automatic brightness control at levels suitable for unassisted viewing, the level of illumination being a function of the ambient illumination. In this regard, the light sensor 203 (FIG. 8) determines the degree of ambient illumination around the weapon sight 10, and the control circuit 216 uses this information to set the level of brightness for the various displays and reticles. As the degree of ambient illumination progressively increases, the degree of illumination of the displays and reticles is also progressively increased.

The rotary switch 27 includes a visible pointer position "VP", in which the control circuit 216 turns on the visible pointer 59 (FIG. 8). The switch 27 also has an IR pointer position "IP", in which the IR pointer 58 (FIG. 8) is turned on. Further, the switch 27 has an IR illumination position "IL", in which the IR illuminator 56 (FIG. 8) is turned on. The switch 27 also has an "OFF" position, in which the illumination of all displays and reticles is off, and in which the IR illuminator 56 and the pointers 58–59 are all off.

As evident from FIG. 12, the rotary switch 26 has three positions, including an "OFF" position, a combat mode position "C", and a programming mode position "P". When the switch is in the programming mode position P, a user in the field can manually set certain parameters, including identification of the types of primary and secondary munitions that the weapon sight 10 is being used with. In this regard, for example, it is possible for a soldier to easily detach one type of grenade launcher from his rifle and then attach a different type of grenade launcher, and the weapon sight 10 needs to be notified of this change if it is to assist the soldier in aiming the replacement grenade launcher.

Figure 13:
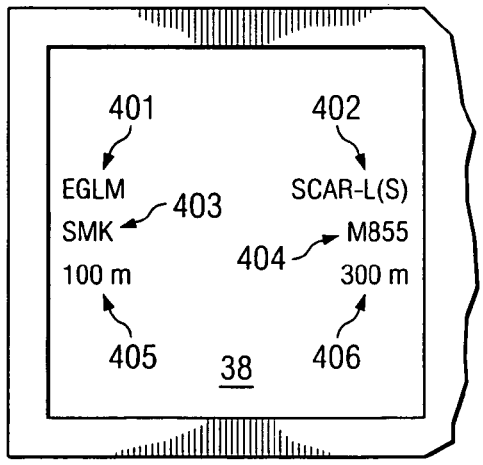
FIG. 13 is a diagrammatic view of the external display, and depicts an example of an image that is presented by the external display during a programming mode.

FIG. 13 is a diagrammatic view of the external display 38, and depicts an example of an image that is presented by the display 38 in the programming mode. In particular, when the rotary switch 26 is set to the programming mode position P, the external display 38 switches from presentation of the type of image shown in FIG. 11 to presentation of the type of image shown in FIG. 13. In FIG. 13, there are two columns of information. The left column relates to the secondary weapon and munition type, and the right column relates to the primary weapon and munition type.

In each column, the top entry identifies a type of weapon, such as a type of rifle or a type of grenade launcher. Thus, for example, the entry 401 indicates that the secondary weapon is a particular type of rifle-mounted grenade launcher EGLM, and the entry 402 indicates that the primary weapon is a particular type of rifle SCAR-L(S). The middle entry in each column is an identification of a particular type of munition, such as a type of grenade or a type of bullet. Thus, for example, the entry 403 indicates that the secondary munition is a particular type of grenade SMK, and the entry 406 indicates that the primary munition is a particular type of bullet M855.

The bottom entry in each column specifies the boresight distance, where the boresight distance is the distance at which the trajectory arc of the corresponding munition would hit a target disposed at the same elevation as the weapon that fires the munition. Thus, the entry 405 is the boresight distance for the secondary munition identified at 403, and the entry 406 is the boresight distance for the primary munition identified at 404.

Upon entry to the programming mode, one of the parameters 401–406 will be selected. This selected parameter will be blinking, in order to indicate that it is the selected parameter. With reference to FIG. 1, the SELECT pushbutton 31 can be repeatedly manually pressed in order to cycle successively through all six parameters 401–406. As each parameter is selected and becomes the active parameter, it blinks. When a given parameter is active and selected, the setting of that parameter can be changed by pressing the up or down pushbuttons 32 and 33 (FIG. 1), in order to cycle forward or backward through a predefined list of available options for that parameter. When a given parameter is changed, other parameters will also sometimes automatically change, without blinking. For example, each time the primary munition type 404 is changed, the associated boresight distance 406 will also typically be changed, so that it conforms to the selected type of primary munition.

Figure 14:
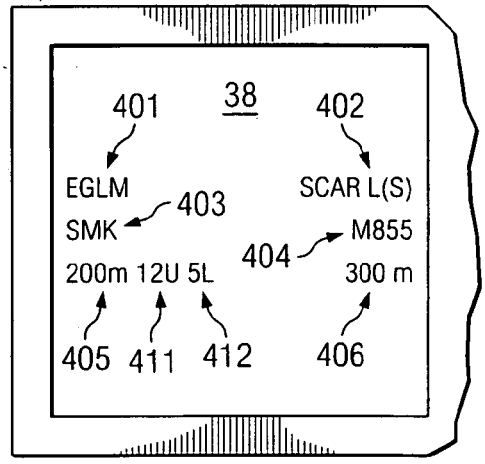
FIG. 14 is a diagrammatic view of the external display, and depicts a further example of an image presented by the external display in the programming mode.

When the boresight distance 405 for the secondary munition is selected, some additional information is presented on the display 38. More specifically, FIG. 14 is a diagrammatic view that is similar to FIG. 13, and that depicts a further example of an image presented by the display 38 in the programming mode. The image shown in FIG. 14 is generally similar to the image shown in FIG. 13, except that the image of FIG. 14 shows the additional information at 411 and 412.

The values at 411 and 412 are offset values for the secondary munition. When the entry 405 has been selected to be the active parameter using the SELECT pushbutton 31, the offset values 411 and 412 are automatically displayed. The TOGGLE pushbutton 34 can then be pressed to successively cycle through the parameters 405, 411 and 412. Each of these parameters can be individually altered while it is selected, by pressing the UP pushbutton 32 or DOWN pushbutton 33. If the TOGGLE pushbutton 34 is pressed and held for at least 2 seconds, then the parameters 405, 411 and 412 will each be reset to a respective default value. When the mode switch 26 is eventually switched away from the programming mode position P, the display 38 will stop displaying the image of FIGS. 13 and 14, and the parameters 401–406 and 411–412 will each be maintained at the value it had when the switch 26 was moved away from the programming mode position P.

When the rotary switch 26 of FIG. 12 is set to the combat position C, the weapon sight 10 operates in the following manner. With reference to FIGS. 9 and 10, the user can place the aiming dot of the main sight reticle 186 or 186A on a target 114, and press the SELECT pushbutton 31. With reference to FIG. 8, the control circuit 216 will respond by operating the laser diode 176 and the optical switch 178 so as to transmit an IR laser pulse to the target 114, and will then reverse the switch 178, so that reflected energy from this pulse will be routed to the detector 177. At the same time that the target 114 is ranged in this manner, the control circuit 216 records the current status of the orientation sensors 206, so that the control circuit has a record of the orientation of the weapon and sight 10 at the point in time when the target was ranged. The control circuit 216 then determines the time lapse between the outgoing and incoming pulses of energy, and calculates the range to the target 114.

The control circuit 216 then calculates a ballistic solution for each of the primary and secondary munitions. In other words, using techniques known in the art, the control circuit 216 calculates an orientation that the weapon would need to have in order for the primary munition to hit the target 114, and will calculates a different orientation that the weapon would need to have in order for the secondary munition to hit the same target. Then, and taking into account the current orientation of the weapon, appropriate information is presented on the various electronic displays of the weapon sight 10. In particular, with reference to FIG. 6, one or more of the LEDs 101–105 is lit in either a continuous or blinking manner, as appropriate. In addition, appropriate information is presented on the internal display, for example at 307, 309, 310 and 312 in FIGS. 9 and 10. Further, with reference to FIG. 11, the target symbol 336 is displayed on the external display 38 at an appropriate location in relation to the crosshairs 331.

This initial position of the target symbol 336 includes a correction for spindrift, based on the measured range to the target. The distance of the target symbol 336 from the crosshairs 331 is nonlinear. Thus, the position of the target symbol 336 will typically not change much in response to movement of the weapon, until the weapon's orientation is such that the secondary munition would be delivered within 50 meters of the target. The target symbol 336 never leaves the display. If the weapon is pointed too far away from the target in any direction, the target symbol 336 simply comes to rest adjacent the top, the bottom or a side of the display 38.

With reference to FIG. 8, and as discussed above, a manual press of the SELECT pushbutton 31 causes the control circuit 216 to use the laser rangefinder to determine the range to the target 114, record the current state of the orientation sensors 206, and then calculate an initial ballistic solution. Thereafter, the control circuit 216 monitors the orientation sensors and repeatedly recalculates the ballistic solution for each of the primary and secondary munitions, using current information from the orientation sensors, and using the previously-determined range to the target 114. Each time the ballistic solution is updated to reflect changes from the orientation sensors 206, all of the displayed information associated with the ballistic solution will also be updated. This includes appropriate updates for the analog display 91, the internal display 183, and the external display 38.

The control circuit 216 continues to repeatedly update the ballistic solution, so long as there is ongoing user activity. For example, operation of any of the switches 26–28 or 31–34 is considered user activity, and firing of either the primary or secondary weapon is considered user activity. In this regard, if the user fires either the primary weapon or the secondary weapon, the acceleration sensor 208 will detect the discharge, and notify the control circuit 216. But if the control circuit 216 does not detect any such user activity for a time interval of 40 seconds, then the control circuit 216 will stop updating the ballistic solution, will discard the target range and other information associated with that ballistic solution, and will return to an idle state in the combat mode.

It should be noted that the user can fire either or both of the primary and secondary weapons one or more times, based on a single laser ranging. In other words, the user is not required to re-range the target after each discharge of either the primary or secondary weapon. Moreover, the user can do only one ranging operation in order to shoot either the primary munition or the secondary munition, and does not need to do two separate ranging operations that are respectively for the primary and secondary munitions. Further, since the sight 10 is used for both the primary and secondary munitions, the center of mass of the sight is near the center of mass of the weapon, and thus a shooter can swing the weapon to bear and hold it on a target with less effort. Due to the use of certain common structure to support sights for both the primary and secondary munitions, including the common housing, optics and electronics, the weight and size of the sight 10 is les than would be the case for two separate sights.

The sight 10 also includes sights that have analog indicators within their field-of-view, such as the analog display 91 for the direct view grenade sight having the reticles 66 and 68. This lets a shooter use his peripheral vision to determine when the weapon is on target, while simultaneously keeping his fovea fixed on the target itself. The use of analog indicators avoids the need to match up a current digital value against a displayed or remembered target digital value.

While a given ballistic solution is active and being repeatedly updated, the pushbuttons UP and DOWN can be used to manually adjust the range that is being used as a basis for calculating the ballistic solution. In addition, the user can press the TOGGLE pushbutton 34 in order to change the grenade type. Thus, for example, if the user ranges a given target, shoots one type of grenade, and then loads a different type of grenade on the grenade launcher, the user does not need to re-range the target in order to use the new grenade type. The user simply presses the TOGGLE pushbutton 34 in order to cycle through the available types of grenades to the new grenade type, and then the calculation of the ballistic solution is immediately adjusted so as to accommodate the new type of grenade. Changing the grenade type in this manner has the effect of changing the pre-programmed grenade type parameter shown as entry 403 in FIG. 13, without any need to enter the programming mode.

When there is no active ballistic solution that is being updated by the control circuit 216, or in other words when the control circuit 216 is in an idle state while in the combat mode, the user can optionally press the TOGGLE pushbutton 34 instead of the SELECT pushbutton 31. As discussed above, pressing the SELECT pushbutton 31 causes the control circuit 216 to use the laser rangefinder to effect automatic ranging of a potential target. In contrast, pressing the TOGGLE pushbutton 34 during the idle state will cause the control circuit 216 to set the target range to a default value of 200 meters, while recording the current status of the orientation sensors 206 so that the control circuit knows the orientation of the weapon and sight 10 at the time when the TOGGLE pushbutton was pressed. The target is assumed to lie along the line-of-aim of the sight 10 at the time that the TOGGLE pushbutton 34 is pressed. The UP and DOWN pushbuttons 32 and 33 can be used to increase or decrease this default range, in a manner similar to that discussed above. Selecting a default range by pressing the TOGGLE pushbutton causes the control circuit 216 to exit its idle state, and to begin repeatedly calculating a ballistic solution in the same basic manner discussed earlier.

While a ballistic solution is active, or in other words while the control circuit 216 is repeatedly updating the ballistic solution, the SELECT pushbutton 31 can be pressed at any time, and will cause the control circuit 216 to discard the current ballistic solution, to immediately use the laser rangefinder to range the target, and to then begin repeatedly calculating a ballistic solution based on this new range. In contrast, pressing the SELECT pushbutton 34 only sets the range to a default value if the control circuit is in an idle state. If the SELECT pushbutton 34 is pressed while a ballistic solution is active, it will cause the control circuit to cycle through the available grenade types, as already discussed above.

An advantage of the external display 38 is that, after a target has been ranged, the user does not need to have a direct view of the target in order to fire the secondary munition. For example, a soldier standing behind a wall can stand up, range a target using the main optical sight, duck down behind the wall, and then accurately aim and fire the secondary munition using the external display 38, while remaining out of view of the target.

Although one embodiment has been illustrated and described in detail, it will be understood that various substitutions and alterations are possible without departing from the spirit and scope of the present invention, as defined by the following claims.

What is claimed is:

1. An apparatus comprising a device that includes:

structure configured to support said device on a weapon;

a range portion that specifies a range to a target;

a sensor portion that provides sensor information representing an orientation of said device;

an electronic control portion that is operatively coupled to said range portion and said sensor portion, and that is responsive to sensor information from said sensor portion and a range from said range portion for calculating how to hit the target with a munition; and a sight that facilitates weapon orientation in preparation to fire the munition, said sight having an analog indicator disposed within its field of view and being responsive to said electronic control portion for indicating how to orient the weapon so that the munition will hit the target.

2. An apparatus according to claim 1, wherein said analog indicator includes a plurality of light-emitting elements that are selectively actuated by said electronic control portion.

3. An apparatus according to claim 2, wherein said light emitting elements include three said elements arranged along a line as a center element between two further elements, said center element being actuated to indicate said device has a desired orientation that would cause the munition to hit the target, and one of said further elements being actuated to indicate said device has an orientation offset from the desired orientation by a selected amount in a direction parallel to the line.

4. An apparatus according to claim 3, wherein when said device is offset from the desired orientation in a direction transverse to the line, the actuated element is caused to blink.

5. An apparatus according to claim 1, wherein said sight includes an electronic display, said electronic control portion causing an electronically generated reticle and an electronically generated symbol to be presented on said display, said symbol being representative of a target and being part of said analog indicator.

6. An apparatus according to claim 5, wherein said electronic control portion causes said symbol to move relative to said reticle as the orientation of said device is changed.

7. A method of operating a weapon-mountable device having a range portion that specifies a range to a target, a sensor portion that provides sensor information representing an orientation of said device, an electronic control portion, and a sight that facilitates weapon orientation in preparation to fire a munition, comprising:

causing said electronic control portion to be responsive to sensor information from said sensor portion and a range from said range portion for calculating how to hit the target with a munition; and causing an analog indicator that is part of said sight and disposed within the field of view of said sight to be responsive to said electronic control portion for indicating how to orient the weapon so the munition will hit the target.

8. A method according to claim 7, including configuring said analog indicator to have a plurality of light-emitting elements that are selectively actuated by said electronic control portion.

9. A method according to claim 8, including:

configuring said light emitting elements so that three said elements are arranged along a line as a center element between two further elements;

actuating said center element to indicate said device has a desired orientation that would cause the munition to hit the target; and actuating one of the further elements to indicate said device has an orientation offset from the desired orientation by a selected amount in a direction parallel to the line.

10. A method according to claim 9, including causing the actuated element to blink when said device is offset from the desired orientation in a direction transverse to the line.

11. A method according to claim 7, including:

configuring said sight to have an electronic display; and causing a reticle and a symbol generated electronically by said electronic control portion to be presented on said display, said symbol being representative of a target and being part of said analog indicator.

12. A method according to claim 11, including causing said symbol to be moved on said display by said electronic control portion in relation to said reticle as the orientation of said device is changed.

13. An apparatus comprising a device that includes:

support means for supporting said device on a weapon;

range means for specifying a range to a target;

sensor means for providing sensor information that represents an orientation of said device;

electronic control means operatively coupled to said range means and said sensor means, and responsive to sensor information from said sensor means and a range from said range means for calculating how to hit the target with a munition; and sight means for facilitating weapon orientation in preparation to fire the munition, said sight means including analog indicator means disposed within a field of view of said sight means and responsive to said electronic control means for indicating how to orient the weapon so that the munition will hit the target.

14. An apparatus according to claim 13, wherein said analog indicator means includes a plurality of light-emitting elements that are selectively actuated by said electronic control means.

15. An apparatus according to claim 14, wherein said light emitting elements include three said elements arranged along a line as a center element between two further elements; and wherein said electronic control means includes element control means for causing said center element to be actuated to indicate said device has a desired orientation that would cause the munition to hit the target, and for causing one of said further elements to be actuated to indicate said device has an orientation that is offset from the desired orientation by a selected amount in a direction parallel to the line.

16. An apparatus according to claim 15, wherein said element control means includes means for causing the actuated element to blink when said device is offset from the desired orientation in a direction transverse to the line.

17. An apparatus according to claim 13, wherein said sight means includes an electronic display; and wherein said electronic control means includes image generating means for causing an electronically generated reticle and an electronically generated symbol to be presented on said display, said symbol being representative of a target and being part of said analog indicator.

18. An apparatus according to claim 17, wherein said image generating means causes said symbol to move relative to said reticle as the orientation of said device is changed.

* * * * *